US009936774B2

(12) United States Patent
Hsu et al.

(10) Patent No.: US 9,936,774 B2
(45) Date of Patent: Apr. 10, 2018

(54) SLIDER FOR SLIDE FASTENER

(71) Applicant: YKK Corporation, Tokyo (JP)

(72) Inventors: Hsien Hsiang Hsu, Taipei (TW); Chun Chun Lai, Taipei (TW); Yuichi Iwase, Taipei (TW)

(73) Assignee: YKK Corporation (JP)

( * ) Notice: Subject to any disclaimer, the term of this patent is extended or adjusted under 35 U.S.C. 154(b) by 0 days.

(21) Appl. No.: 15/406,868

(22) Filed: Jan. 16, 2017

(65) Prior Publication Data

US 2017/0224062 A1 Aug. 10, 2017

(30) Foreign Application Priority Data

Feb. 4, 2016 (JP) ..... 2016-000514 U

(51) Int. Cl.

*A44B 19/30* (2006.01)
*A44B 19/26* (2006.01)
*A44B 19/36* (2006.01)

(52) U.S. Cl.

CPC ..... *A44B 19/305* (2013.01); *A44B 19/262* (2013.01); *A44B 19/36* (2013.01)

(58) Field of Classification Search

CPC ..... A44B 19/305; A44B 19/262; A44B 19/36; Y10T 24/2568; Y10T 24/2586

See application file for complete search history.

(56) References Cited

U.S. PATENT DOCUMENTS 2,261,133 A * 11/1941 Grant ..... A44B 19/305 24/419
2,540,693 A * 2/1951 Shur ..... A44B 19/305 24/419
2,784,474 A * 3/1957 Morin ..... A44B 19/308 24/424
2,983,017 A * 5/1961 Harmon ..... A44B 19/305 24/416
3,075,269 A * 1/1963 Simberg ..... A44B 19/305 24/419
3,112,546 A * 12/1963 Jensen ..... A44B 19/305 24/419
3,335,586 A * 8/1967 Levine ..... A44B 19/305 24/419

(Continued)

FOREIGN PATENT DOCUMENTS

CN 103082589 A 5/2013
JP H07-061288 B2 7/1995

*Primary Examiner* — Robert Sandy
*Assistant Examiner* — Rowland Do
(74) *Attorney, Agent, or Firm* — Kilpatrick Townsend & Stockton LLP

(57) ABSTRACT

There is provided a slider for a slide fastener. The slider includes a body, a pull tab, a shaft member, and a coil spring. The pull tab has a base portion, a gripper and a claw portion protruding from the base portion. The shaft member is configured to rotatably support the pull tab relative to the body. The coil spring is attached around the shaft member to urge the gripper to be laid down toward the body. A claw guide portion allows a tip end of the claw portion to protrude into the guide groove. A restricting portion of the body restricts rotation of the pull tab when the pull tab is raised by a predetermined angle from the body. A restricted portion of the pull tab comes in contact with the restricting portion when the pull tab is raised by the predetermined angle from the body.

15 Claims, 10 Drawing Sheets

(56) References Cited

U.S. PATENT DOCUMENTS

| | | | | | |
|---|---|---|---|---|---|
| 3,597,810 | A | * | 8/1971 | Ilotte | A44B 19/305 24/419 |
| 3,820,203 | A | * | 6/1974 | Takamatsu | A44B 19/305 24/419 |
| 4,827,580 | A | * | 5/1989 | Yaguramaki | A44B 19/305 24/419 |
| 5,152,036 | A | | 10/1992 | Oda et al. | |
| 5,632,070 | A | * | 5/1997 | Wakabayashi | A44B 19/305 24/419 |
| 2009/0064468 | A1 | * | 3/2009 | Iwase | A44B 19/305 24/419 |
| 2014/0310923 | A1 | | 10/2014 | Matsushima | |

* cited by examiner

SLIDER FOR SLIDE FASTENER

The present application claims priority to Japanese Utility Model Patent Application No. 2016-000514, filed on Feb. 4, 2016 and entitled "Slider for Slide Fastener," the entire contents of which are hereby incorporated by reference.

TECHNICAL FIELD

The present invention relates to a slider for slide fastener used, for example, in a slide fastener having a stop mechanism.

BACKGROUND

Conventionally, sliders for slide fasteners having a stop mechanism are known (see Patent Documents 1 and 2).

Patent Document 1: Japanese Patent Application Publication No. H07-061288B

Patent Document 2: Chinese Patent Application Publication No. 103082589A

However, in a technique described in Patent Document 1, the number of parts is large, and a pull tab and a locking claw are formed as separate bodies. Therefore, when the pull tab has been raised up by a user, the pull tab is likely to wobble and thus is unstable. Further, in a technique described in Patent Document 2, a pull tab is attached to a body by crimping, and the pull tab rotates while itself serving as a shaft. Thus, when the pull tab has been raised up by a user, the pull tab is likely to wobble and thus is unstable.

SUMMARY

It is therefore an object of the present invention to provide a slider for slide fastener, in which when a pull tab has been raised up by a user, the pull tab can be remained stable.

According to an aspect of the embodiments of the present invention, there is provided a slider for slide fastener, comprising: a body having an upper blade and a lower blade connected by a guide post and having a guide groove between the upper blade and the lower blade; a pull tab having a base portion rotatably attached to the body, a gripper extending from the base portion and a claw portion protruding from the base portion; a shaft member inserted through the pull tab, supported by the body at both ends thereof and configured to rotatably support the pull tab relative to the body; and a coil spring attached around the shaft member so as to urge the gripper of the pull tab to be laid down toward the body, wherein the body comprises: a claw guide portion formed in the upper blade to allow a tip end of the claw portion to protrude into the guide groove when the pull tab is laid down toward the body; and a restricting portion for restricting rotation of the pull tab when the pull tab is raised by a predetermined angle from the body, and wherein the pull tab comprises: a restricted portion coming in contact with the restricting portion when the pull tab is raised by the predetermined angle from the body.

In the slider for slide fastener, the restricted portion may be a flat surface.

In the slider for slide fastener, the restricting portion may be a flat surface.

In the slider for slide fastener, a width, in a right and left direction, of the restricted portion may be longer than a half of a width, in the right and left direction, of an upper surface of the base portion.

In the slider for slide fastener, the body may comprise: shaft member support portions protruding upward from both end portions, in a right and left direction, of the upper blade and configured to allow the shaft member to be inserted therein; and a pull tab receiving portion formed in a recess shape at a middle portion, in the right and left direction, between the shaft member support portions and configured to receive the base portion of the pull tab therein, and when the pull tab is raised up, the tip end of the claw portion may be concealed without protruding from the body as viewed in the right and left direction.

In the slider for slide fastener, the restricting portion may have a first restricting portion on a bottom surface at a front side of the shaft member support portions, and the restricted portion may have a first restricted portion on an end surface of the base portion opposite to the gripper.

In the slider for slide fastener, the base portion may have a contact portion configured to come in contact with the first restricting portion, the contact portion may have a shape of an arc concentric with the shaft member and extends from the first restricted portion to the claw portion.

In the slider for slide fastener, the restricting portion may have a second restricting portion on a wall surface at a front side of the pull tab receiving portion, and the restricted portion may have a second restricted portion on an end surface of the base portion opposite to the claw portion.

In the slider for slide fastener, the base portion may have a body attachment portion comprising: a coil spring receiving portion opened at one of right and left sides thereof to receive the coil spring therein; and a shaft member insertion portion provided at the other of the right and left sides to allow the shaft member to be inserted therethrough.

In the slider for slide fastener, the coil spring receiving portion may comprise: a bottom portion allowing the coil spring to be installed thereon; and a side wall portion formed with the shaft member insertion portion.

In the slider for slide fastener, at least a part of the claw portion and at least a part of the side wall portion may be included in one predetermined cross section perpendicular to the right and left direction.

In the slider for slide fastener, the bottom portion may have a coil spring holding portion at a side thereof, which is one of the right and left sides thereof and opposite to the gripper.

In the slider for slide fastener, the coil spring may comprise: a coil portion having a coil shape and configured to allow the shaft member to be inserted therethrough; a first pressed portion protruding from one end of the coil portion toward an outer peripheral side thereof and configured to be in contact with the bottom portion of the coil spring receiving portion; and a second pressed portion protruding from the other end of the coil portion toward an outer peripheral side thereof opposite to the first pressed portion and configured to be held by the coil spring holding portion of the coil spring receiving portion.

In the slider for slide fastener, the first pressed portion may have a first bent portion extending to one side of the right and left direction after protruding from the one end of the coil portion toward the outer peripheral side, and the second pressed portion may have a second bent portion extending to the other side of the right and left direction after protruding from the other end of the coil portion toward the outer peripheral side thereof opposite to the first pressed portion.

In the slider for slide fastener, the base portion may have a recess-shaped stepped portion provided at a side, on which the coil spring is installed, of right and left sides of the restricted portion.

According to the slider for slide fastener of one embodiment of the present invention, the pull tab can be remained stable when the pull tab has been raised up by a user.

DETAILED DESCRIPTION

Hereinafter, a slider 1 used in a slide fastener will be described in detail by way of example with reference to the accompanying drawings.

Figure 1:
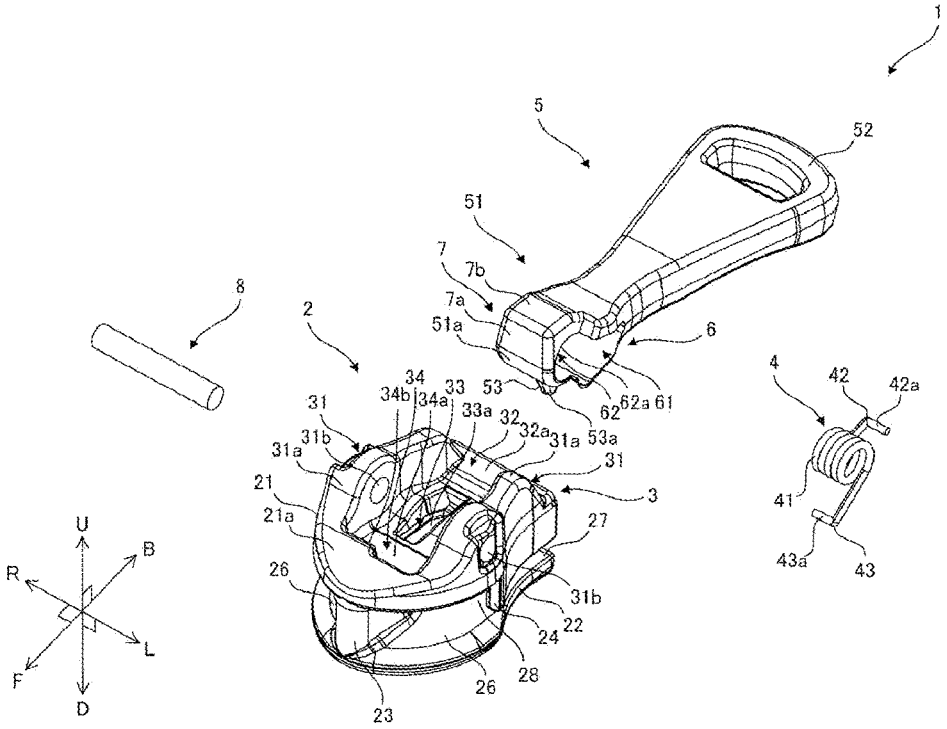
FIG. 1 is an exploded perspective view of a slider of a first embodiment.

FIG. 1 is an exploded perspective view of the slider 1 of a first embodiment. Meanwhile, for all following embodiments, as shown in FIG. 1, an arrow U refers to an upward direction, an arrow D refers to a downward direction, an arrow F refers to a front direction, an arrow B refers to a rear direction, an arrow L refers to a left direction and an arrow R refers to a right direction.

In addition, the slider 1 is intended to be equipped on a slide fastener and is used to engage and disengage fastener elements provided on a pair of right and left fastener chains, not shown. The fastener chains are constructed by attaching a plurality of individual fastener elements, which are made of metal or thermoplastic resin, in a row shape on woven knitted fastener tapes, or by stitching continuous fastener elements, which are formed in a coil or zigzag shape, on the respective fastener tapes.

In the slide fastener, the fastener elements of the right and left fastener chains are engaged with each other by moving the slider 1 in a front direction as shown by the arrow F and are disengaged from each other by moving the slider 1 in a rear direction as shown by the arrow B. Herein, the front and rear direction (F-B direction) also corresponds to a tape length direction of the fastener tapes. A right and left direction (R-L direction) as shown by the arrows R and L is a direction parallel to upper and lower blades 21 and 22 of a body 2 of the slider 1, as described below, and also perpendicular to the front and rear direction. In addition, an upward and downward direction (U-D direction) as shown by the arrows U and D is a direction perpendicular to the upper and lower blades 21 and 22 and is also referred to as a front and back direction.

Figure 2:
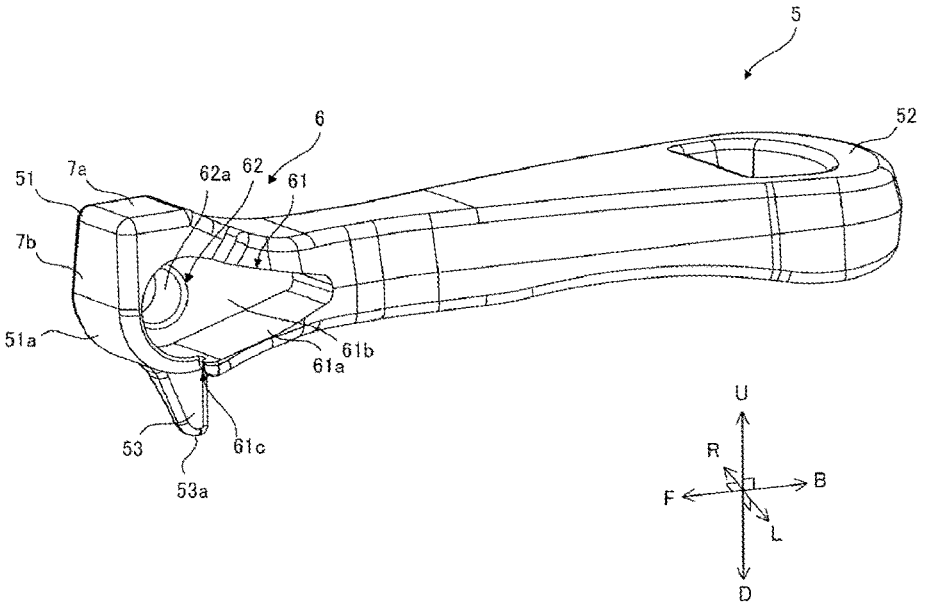
FIG. 2 is a perspective view of a pull tab of the first embodiment.

As shown in FIGS. 1 and 2, the slider 1 for slide fastener having an automatic stop mechanism according to the first embodiment is assembled of four members, i.e., a body 2, a coil spring 4, a pull tab 5 and a shaft member 8. The body 2 and the pull tab 5 are preferably molded by die-casting metals, such as aluminum alloy or zinc alloy.

The body 2 of the slider 1 is constituted of an upper blade 21, a lower blade 22 and a guide post 23 connecting a front F side of the upper blade 21 with the a front F side of the lower blade 22. Upper blade flanges 24 for guiding fastener elements, not shown, are respectively formed to protrude from right and left side edges of the upper and lower blades 21 and 22 located at a rear B side thereof. Between the upper and lower blades 21, 22, shoulder mouths 26 are formed on both right and left sides of the guide post 23 at the front side of the body 2, a rear mouth 27 is formed at a rear end of the body 2, and also a guide groove 28 for guiding fastener elements, not shown, is formed to communicate the shoulder mouths 26 with the rear mouth 27.

On an upper surface 21*a* of the upper blade 21 of the body 2, a pull tab attaching portion 3 is formed to allow the pull tab 5 to be attached thereon. The pull tab attaching portion 3 has shaft member support portions 31 for supporting the shaft member 8 and a pull tab receiving portion 32 for receiving a part of the pull tab 5 therein.

The shaft member support portions 31 of the present embodiment are defined by a protrusions 31*a* protruding upward (U direction) from both end portions, in the right and left direction (L-R direction), of the upper surface 21*a* of the upper blade 21, and a hole 31*b* formed in the protrusions 31*a* to allow the shaft member 8 to be inserted therein.

The pull tab receiving portion 32 of the present embodiment is defined by a recess 32*a* formed at a middle portion, in the right and left direction (L-R direction), between the protrusions 31*a*. The pull tab receiving portion 32 includes a claw guide portion 33 configured to allow a claw portion 53 formed on the pull tab 5 to be moved therein. The claw guide portion 33 of the present embodiment is defined by a hole 33*a* extending through the upper blade 21. The pull tab receiving portion 32 includes a restricting portion 34 for restricting movement of the pull tab 5. The restricting portion 34 of the present embodiment has a first restricting portion 34*a* formed on a bottom surface at a front (F direction) side of the shaft member support portions 31, and a second restricting portion 34*b* formed on a wall surface at the front (F direction) side of the shaft member support portions 31. Alternatively, the restricting portion 34 may have only either one. Preferably, the first restricting portion 34*a* and the second restricting portion 34*b* are formed as a flat surface.

As such, since the restricting portion 34 has the first restricting portion 34*a* on the bottom surface at the front (F direction) side of the shaft member support portions 31, and a restricted portion 7 has a first restricted portion 7*a* on an end surface of a base portion 51 opposite to a gripper 52, a space can be effectively utilized. In addition, since the restricting portion 34 has the second restricting portion 34*b* on the wall surface at the front (F direction) side of the pull tab receiving portion 32, and the restricted portion 7 has a second restricted portion 7*b* on an end surface of the base portion 51 opposite to the claw portion 53, a space can be effectively utilized. Also, since at least one of the restricting portion 34 and the restricted portion 7 is a flat surface, rotation can be stably restricted.

FIG. 2 is a perspective view of the pull tab 5 of the first embodiment.

The pull tab 5 includes a base portion 51, a gripper 52 and a claw portion 53. The base portion 51 has a body attachment portion 6 for attaching the pull tab 5 to the body 2, and a restricted portion 7 coming in contact with the restricting portion 34 when the pull tab 5 is raised by a predetermined angle from the body 2. The base portion 51 can be received in the pull tab receiving portion 32 when the pull tab 5 is laid down. The gripper 52 is a plate-shaped portion extending from the base portion 51. A user can raise up and lay down the pull tab 5 while gripping the gripper 52 with his or her fingers. Preferably, the gripper 52 has a hole formed in a part thereof. Meanwhile, in the present embodiment, raising up the pull tab 5 means a state where the gripper 52 of the pull tab 5 is oriented in an upward direction (U direction) in FIG. 1, whereas laying down the pull tab 5 means a state where the gripper 52 of the pull tab 5 is oriented in a rear direction (B direction) in FIG. 1.

The restricted portion 7 comes in contact with the restricting portion 34 when the pull tab 5 is raised by a predetermined angle, thereby stopping rotation of the pull tab 5. The restricted portion 7 of the present embodiment has a first restricted portion 7*a* formed on an end surface of the base portion 51 opposite to the gripper 52, which corresponds to a front (F direction) side thereof in FIG. 1, and a second restricted portion 7*b* formed on an end surface of the base portion 51 opposite to the claw portion 53, which corresponds to an upper (U direction) side thereof in FIG. 1. Alternatively, the restricted portion 7 may have only either one corresponding to the restricting portion 34. A contact portion 51*a*, which includes an arc-shaped curved surface and is configured to come in contact with the first restricting portion 34*a*, is provided to extend from the first restricted portion 7*a* to the claw portion 53. Preferably, the contact portion 51*a* is formed in the shape of an arc concentric with the shaft member 8. Hereinafter, the contact portion 51*a* is sometimes referred to as the curved surface 51*a*.

The body attachment portion 6 has a coil spring receiving portion 61 and a shaft member insertion portion 62.

The coil spring receiving portion 61 is configured to receive therein a coil spring 4 for urging the claw portion 53 toward the claw guide portion 33 when the pull tab 5 is attached to the body 2. The coil spring receiving portion 61 of the present embodiment is formed in the shape of a recess by opening one of right and left (L-R direction) sides of the base portion 51.

The coil spring receiving portion 61 has a bottom portion 61*a* at a side thereof where the claw portion 53 exists, and has a side wall portion 61*b* at the other of the right and left (L-R direction) sides. The side wall portion 61*b* is provided with the shaft member insertion portion 62. Preferably, at least a part of the claw portion 53 and the side wall portion 61*b* is included in a predetermined cross section perpendicular to the right and left direction (L-R direction).

The bottom portion 61*a* has a coil spring holding portion 61*c* at a side thereof, which is one of right and left (L-R direction) sides thereof and opposite to the gripper 52. The coil spring holding portion 61*c* of the present embodiment is formed in a notch shape.

The shaft member insertion portion 62 is configured so that the shaft member 8 for rotatably supporting the pull tab 5 is inserted therethrough. The shaft member insertion portion 62 of the present embodiment is defined by a hole 62*a* formed in the right and left direction (L-R direction) in the base portion 51.

As such, since the body attachment portion 6 has the side wall portion 61*b*, the base portion 51 of the pull tab 5 can have an increased strength. Also, since the body attachment portion 6 is configured so that the hole 62*a* as the shaft member insertion portion 62 is formed in the side wall portion 61*b*, the hole 62*a* can have an increased precision. Further, since at least a part of the claw portion 53 and at least a part of the side wall portion 61*b* are included in one predetermined cross section perpendicular to the right and left direction (L-R direction), zinc can be well supplied from the side wall portion 61*b* into the claw portion 53 during die-cast injection molding, thereby ensuring that the claw portion 53 is stably molded.

When the pull tab 5 is laid down, the claw portion 53 protrudes from the base 51 to pass through the hole 33*a* as the claw guide portion 33. Also, when the pull tab 5 is raised up, a tip end 53*a* of the claw portion 53 is preferably concealed without protruding from the body 2 as viewed in the right and left direction (L-R direction).

As shown in FIG. 1, the coil spring 4 includes a coil portion 41 having a coil shape and configured to allow the shaft member 8 to be inserted therethrough, a first pressed portion 42 protruding from one end of the coil portion 41 toward an outer peripheral side thereof and thus configured to be in contact with the bottom portion 61*a* of the coil spring receiving portion 61, and a second pressed portion 43 protruding from the other end of the coil portion 41 toward an outer peripheral side thereof opposite to the first pressed portion 42 and thus configured to be held by the coil spring holding portion 61*c* of the coil spring receiving portion 61.

The first pressed portion 42 has a first bent portion 42*a* extending to one side of the right and left direction (L-R direction) after protruding from the one end of the coil portion 41 toward the outer peripheral side. The second pressed portion 43 has a second bent portion 43*a* extending to the other side of the right and left direction (L-R direction) after protruding from the other end of the coil portion 41 toward the outer peripheral side thereof opposite to the first pressed portion 42. Thus, the coil spring 4 can be stably received.

Figure 3:
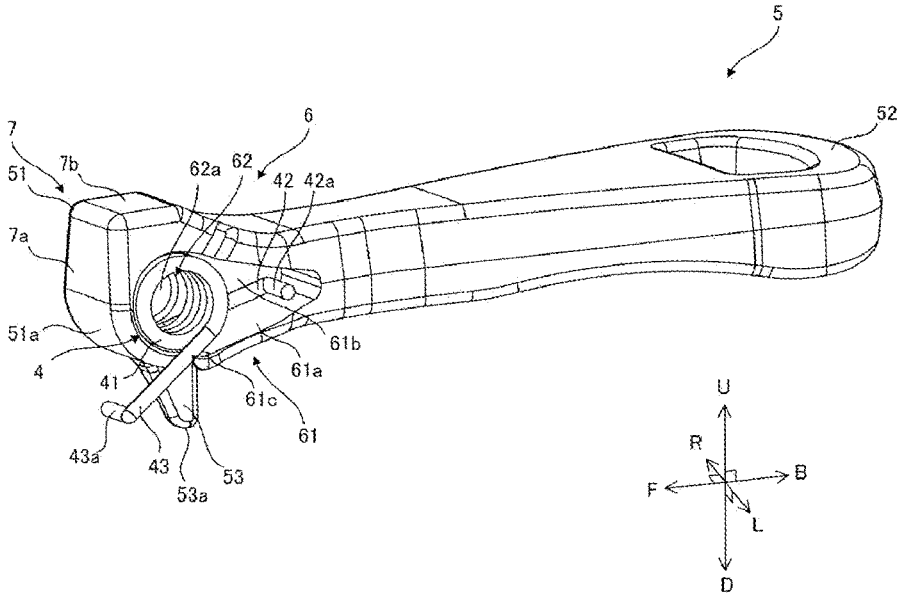
FIG. 3 is a perspective view showing a state where a coil spring is attached to the pull tab of the first embodiment.
Figure 4:
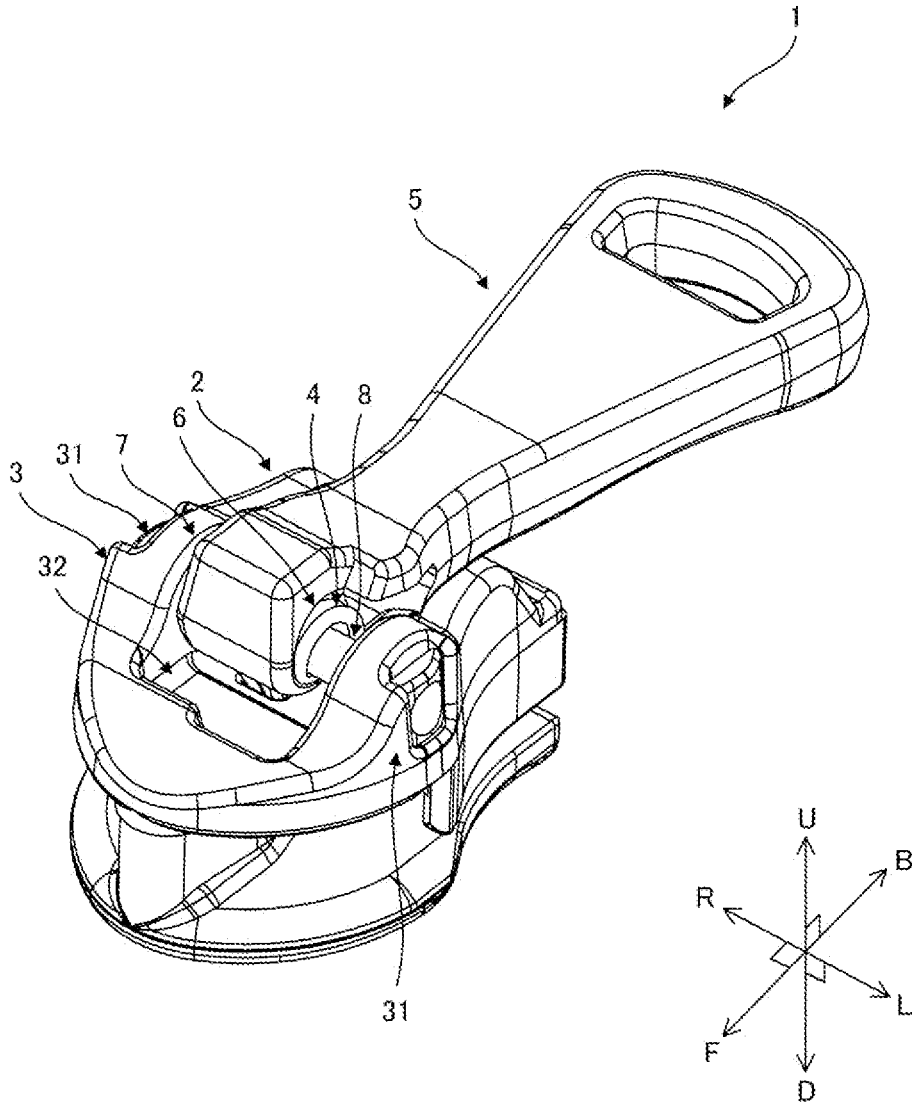
FIG. 4 is a perspective view of the slider of the first embodiment.

FIG. 3 is a perspective view showing a state where the coil spring 4 is attached to the pull tab 5 of the first embodiment. FIG. 4 is a perspective view of the slider 1 of the first embodiment.

When the slider 1 is assembled, the coil spring 4 is first attached to the coil spring receiving portion 61 of the pull tab 5. The coil spring 4 is received in such a manner that the first pressed portion 42 is positioned toward the side wall portion 61*b* and the coil portion 41 continues from one of the right and left (L-R direction) sides of the hole 62*a*, which defines the shaft member insertion portion 62. Meanwhile, the first pressed portion 42*c* may be in contact with the side wall portion 61*b*. The second pressed portion 43 is partially inserted into the coil spring holding portion 61*c*.

Subsequently, the base portion 51 of the pull tab 5, in which the coil spring 4 has been received, is received in the pull tab receiving portion 32. Finally, the shaft member 8 is inserted through the shaft member support portions 31, the coil portion 41 of the coil spring 4 and the shaft member insertion portion 62.

In this way, since the first pressed portion 42 is positioned toward the side wall portion 61*b*, the coil spring 4 can be easily positioned in the coil spring receiving portion 61. In particular, if the first pressed portion 42 is brought in contact with the side wall portion 61*b*, positioning can be more easily performed.

Further, since the second pressed portion 43 is partially inserted in the coil spring holding portion 61*c*, the coil spring 4 can be received in the coil spring receiving portion 61 in a state where a preload is applied to the coil spring 4. Therefore, only by attaching the pull tab 5 on the body 2, an urging force in a direction, toward which the pull tab 5 is laid down, can be acted thereon.

Further, in a state where the coil spring 4 is received in the coil spring receiving portion 61, the pull tab 5 can be attached to the body 2 from directly above. Therefore, deformation of the coil spring 4 can be prevented and also the pull tab 5 can be easily mounted on the body 2.

Figure 5:
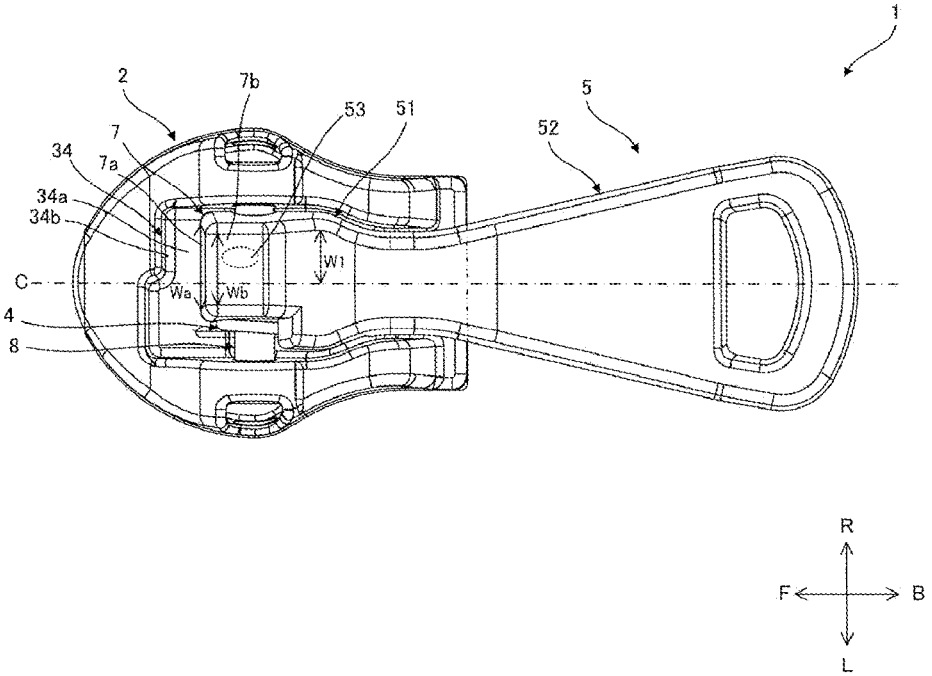
FIG. 5 is a top view of the slider of the first embodiment.

FIG. 5 is a top view of the slider 1 of the first embodiment.

As shown in FIG. 5, the base portion 51 of the pull tab 5 is formed to be asymmetric with respect to the center line C thereof in the front and rear direction (F-B direction). A width Wa, in the right and left direction (L-R direction), of the first restricted portion 7*a* and a width Wb, in the right and left direction (L-R direction), of the second restricted portion 7*b* are longer than a half of a width W1, in the right and left direction, of an upper surface of the base portion 51. Herein, it should be noted that chamfered portions are not considered in the widths.

As such, since the widths Wa, Wb, in the right and left direction (L-R direction), of the restricted portion 7 are longer than a half of the width W1, in the right and left direction, of the upper surface of the base portion 51, an increased contact area between the restricting portion 34 and the restricted portion 7 when the pull tab 5 is raised up can be obtained, thereby ensuring that the pull tab 5 is stably held on the body 2.

Operations of the slider 1 of the first embodiment will be now described.

Figure 6:
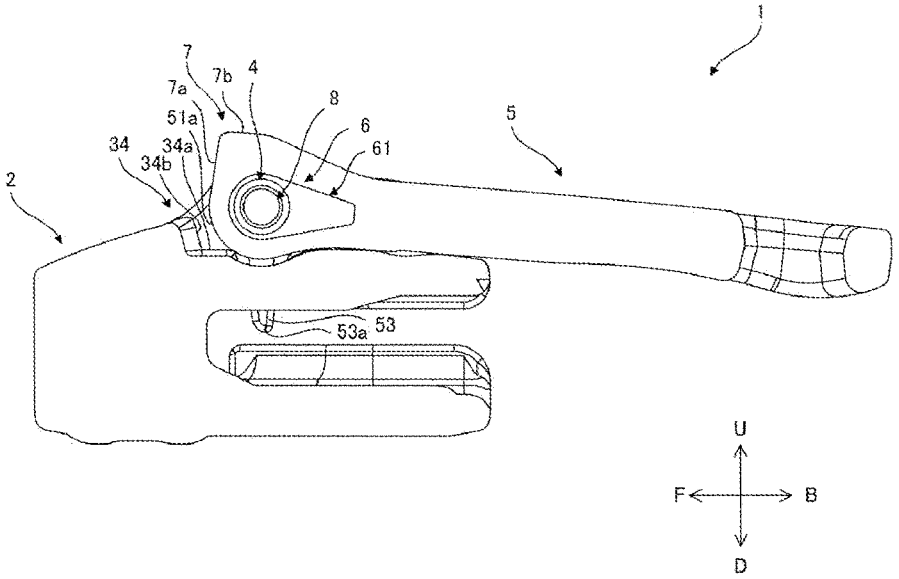
FIG. 6 is a sectional view taken along a direction perpendicular to a right and left direction (L-R direction) at a location where a coil spring receiving portion is included, illustrating a state where the pull tab of the slider of the first embodiment is laid down.

FIG. 6 is a sectional view taken along a direction perpendicular to the right and left direction (L-R direction) at a location where the coil spring receiving portion 61 is included, illustrating a state where the pull tab 5 of the slider 1 of the first embodiment is laid down.

The slider 1 is configured so that if the pull tab 5 is mounted on the body 2, the pull tab 5 is laid down, as shown in FIG. 6, under the action of an elastic force of the coil spring 4. In this state, the tip end 53*a* of the claw portion 53 is inserted between elements, not shown, thereby stopping the slider 1 from moving in the front and rear direction.

Figure 7:
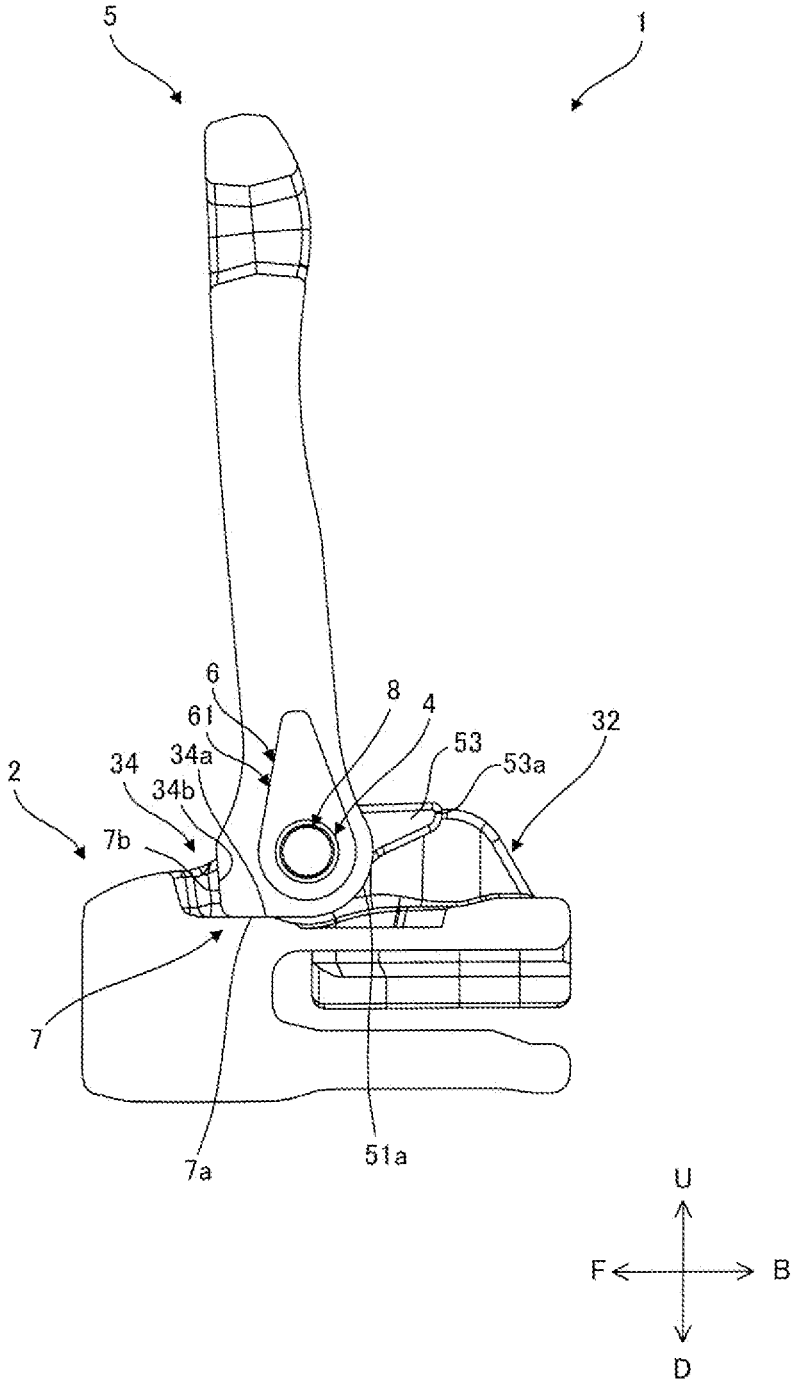
FIG. 7 is a sectional view taken along the direction perpendicular to the right and left direction (L-R direction) at the location where the coil spring receiving portion is included, illustrating a state where the pull tab of the slider of the first embodiment is raised up.

FIG. 7 is a sectional view taken along a direction perpendicular to the right and left direction (L-R direction) at a location where the coil spring receiving portion 61 is included, illustrating a state where the pull tab 5 of the slider 1 of the first embodiment is raised up.

If the pull tab 5 is raised up, as shown in FIG. 7, from the state shown in FIG. 6, the claw portion 53 rotates and escapes from between elements, not shown. Also, as the pull tab 5 is rotated, the first restricted portion 7*a*, which is formed by a flat end surface, comes in contact with the first restricting portion 34*a* on the bottom surface of the pull tab receiving portion 32 after the curved surface 51*a* of the base portion 51 comes in contact therewith, and then the second restricted portion 7*b*, which is formed by a flat end surface, comes in contact with the second restricting portion 34*b* on the wall surface of the pull tab receiving portion 32.

Therefore, the pull tab 5 is controlled not to be able to be further rotated. At this time, the tip end 53*a* of the claw portion 53 is concealed without protruding from the body 2 as viewed in the right and left direction (L-R direction). Meanwhile, in the present embodiment, an allowable rotation angle of the pull tab 5 is set to about 90°. However, within a range in which the claw portion 53 does not protrude from the recess 32*a* of the pull tab receiving portion 32, angles of the first restricted portion 7*a* and the first restricting portion 34*a* and also angles of the second restricted portion 7*b* and the second restricting portion 34*b* may be changed and thus the allowable rotation angle of the pull tab 5 may be also changed.

In this way, since the curved surface 51*a* of the base portion 51 comes in contact with the first restricting portion 34*a* as the pull tab 5 is rotated, the pull tab 5 can be smoothly rotated. Also, since the first restricted portion 7*a* and the first restricting portion 34*a* are formed as flat surfaces, rotation can be stably restricted. Further, the second restricted portion 7*b* and the second restricting portion 34*b* are also formed as flat surfaces, thereby ensuring that the rotation is more stably restricted. Further, since when the pull tab 5 is raised up, the tip end 53*a* of the claw portion 53 is concealed without protruding from the body 2 as viewed in the right and left direction (L-R direction), it is possible to prevent fingers and the like from being caught on the tip end 53*a*.

If the pull tab 5 is released from the state shown in FIG. 7, the slider 1 is configured so that as shown in FIG. 6, the pull tab 5 is automatically rotated under the action of an elastic force of the coil spring 4 and then the tip end 53*a* of the claw portion 53 is inserted between elements, not shown.

Next, a second embodiment will be described.

Figure 8:
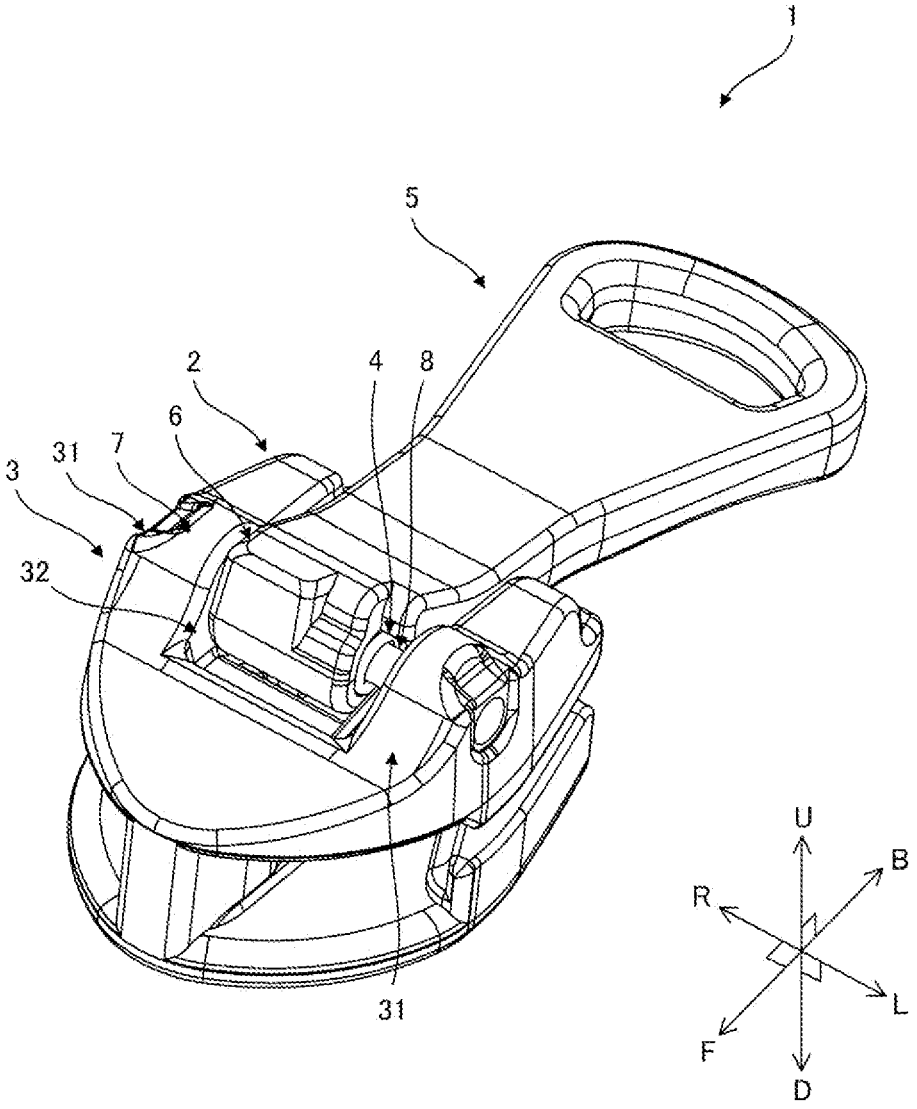
FIG. 8 is a perspective view of a slider of a second embodiment.
Figure 9:
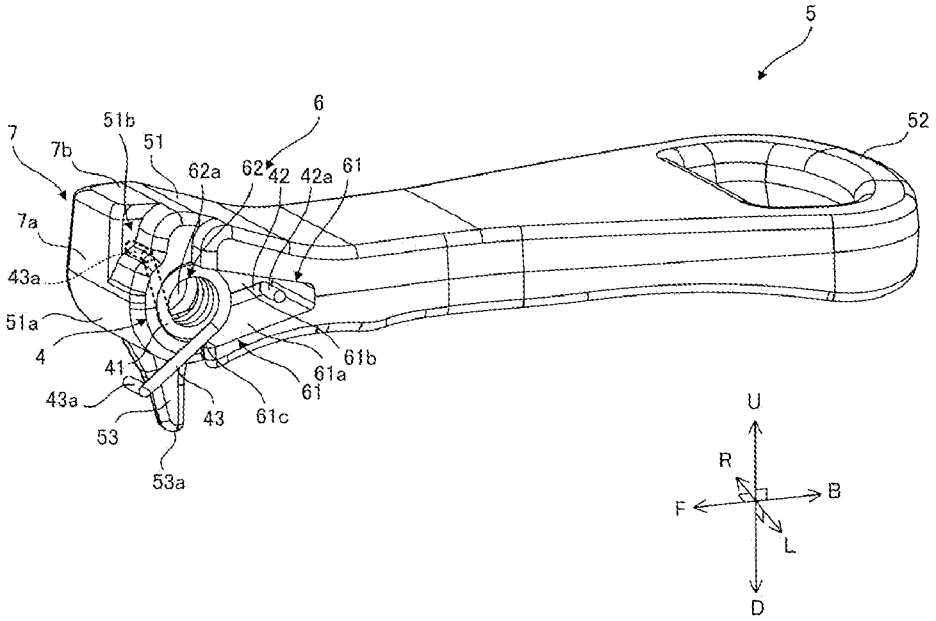
FIG. 9 is a perspective view showing a state where a coil spring is attached to a pull tab of the second embodiment.

FIG. 8 is a perspective view of a slider 1 of the second embodiment. FIG. 9 is a perspective view showing a state where a coil spring 4 is attached to a pull tab 5 of the second embodiment.

The slider 1 of the second embodiment has a stepped portion 51*b* adjacent to a restricted portion 7 of a base portion 51 of the pull tab 5. The other structures are the same as those of the slider 1 of the first embodiment.

The stepped portion 51*b* is provided at a side, on which a coil spring 4 is installed, of right and left (L-R direction) sides of the restricted portion 7. Preferably, the stepped portion 51*b* and a coil spring receiving portion 61 are formed to be included in one cross section perpendicular to the right and left direction (L-R direction). A first restricted portion 7*a* and a second restricted portion 7*b* are formed in a protrusion shape, whereas the stepped portion 51*b* is formed in a recess shape.

By forming the stepped portion 51*b*, as the pull tab 5 is raised up, a second bent portion 43*b* of a second pressed portion 43 of the coil spring 4 is fitted from a curved surface 51*a* into the stepped portion 51*b*. Therefore, a resistance occurred due to the second bent portion 43*b* while the pull tab 5 is rotated can be reduced, thereby allowing the pull tab 5 to be more smoothly rotated.

Figure 10:
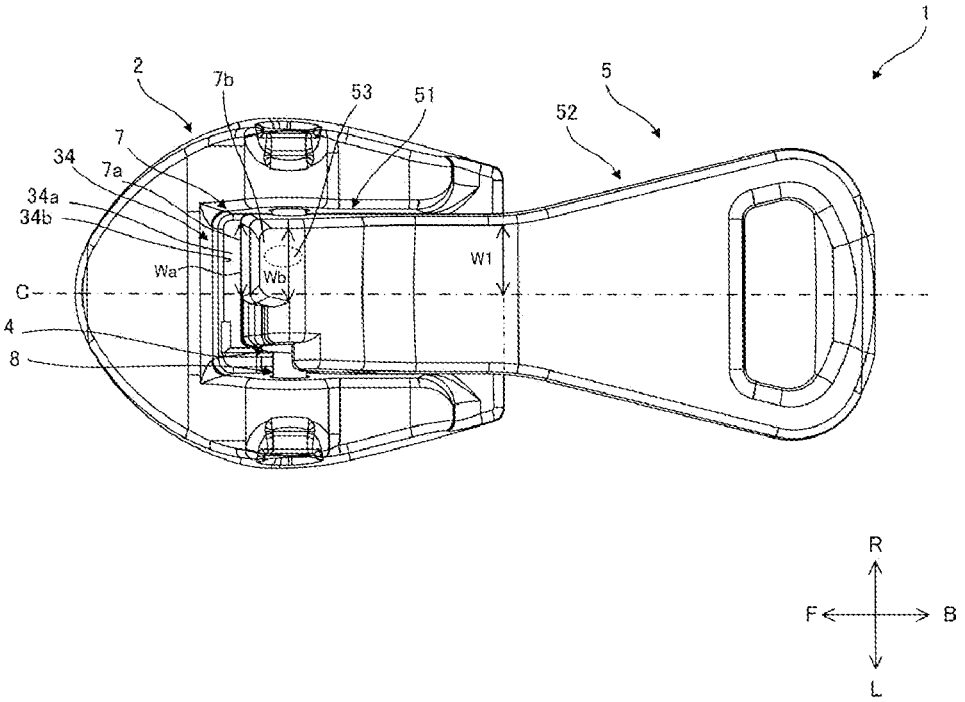
FIG. 10 is a top view of a slider of the second embodiment.

FIG. 10 is a top view of the slider 1 of the second embodiment.

As shown in FIG. 10, the base portion 51 of the pull tab 5 is formed to be asymmetric with respect to the center line C thereof in the front and rear direction (F-B direction). A width Wa, in the right and left direction (L-R direction), of the first restricted portion 7*a* and a width Wb, in the right and left direction (L-R direction), of the second restricted portion 7*b* are longer than a half of a width W1, in the right and left direction, of an upper surface of the base portion 51. Herein, it should be noted that chamfered portions are not considered in the widths.

As such, since the widths Wa, Wb, in the right and left direction (L-R direction), of the restricted portion 7 are longer than a half of the width W1, in the right and left direction, of the upper surface of the base portion 51, an increased contact area between the restricting portion 34 and the restricted portion 7 when the pull tab 5 is raised up can be obtained, thereby ensuring that the pull tab 5 is stably held on the body 2.

As described above, according to the present embodiment, the slider 1 includes a body 2 having an upper blade 21 and a lower blade 22 connected by a guide post 23 and also having a guide groove 28 between the upper blade 21 and the lower blade 22; a pull tab 5 having a base portion 51 rotatably attached to the body 2, a gripper 52 extending from the base portion 51 and a claw portion 53 protruding from the base portion 51; a shaft member 8 inserted through the pull tab 5, supported by the body 2 at both ends thereof and configured to rotatably support the pull tab 5 relative to the body 2; and a coil spring 4 attached around the shaft member 8 so as to urge the gripper 52 of the pull tab 5 to be laid down toward the body 2. Also, the body 2 includes a claw guide portion 33 formed in the upper blade 21 to allow a tip end of the claw portion 53 to protrude into the guide groove 28 when the pull tab 5 is laid down toward the body 2; and a restricting portion 34 for restricting rotation of the pull tab 5 when the pull tab 5 is raised by a predetermined angle from the body 2. Further, the pull tab 5 includes a restricted portion 7 coming in contact with the restricting portion 34 when the pull tab 5 is raised by the predetermined angle from the body 2. Therefore, when the pull tab has been raised up by a user, the pull tab can be remained stable.

Also, according to the slider 1 of the present embodiment, the restricted portion 7 is a flat surface, thereby ensuring that rotation is stably restricted.

Further, according to the slider 1 of the present embodiment, the restricting portion 34 is a flat surface, thereby ensuring that rotation is stably restricted.

Further, according to the slider 1 of the present embodiment, widths Wa, Wb, in the right and left direction (L-R direction), of the restricted portion 7 are longer than a half of a width W1, in the right and left direction, of an upper surface of the base portion 51. Therefore, an increased contact area between the restricting portion 34 and the restricted portion 7 when the pull tab 5 is raised up can be obtained, thereby ensuring that the pull tab 5 is stably held on the body 2.

Further, according to the slider 1 of the present embodiment, the body 2 includes shaft member support portions 31 protruding upward (U direction) from both end portions, in the right and left direction (L-R direction), of the upper blade 21 and configured to allow the shaft member 8 to be inserted therein, and a pull tab receiving portion 32 formed in a recess shape at the middle portion, in the right and left direction (L-R direction), between the shaft member support portions 31 and configured to receive the base portion 51 of the pull tab 5 therein. Also, when the pull tab 5 is raised up, the tip end 53*a* of the claw portion 53 is concealed without protruding from the body 2 as viewed in the right and left direction (L-R direction). Therefore, it is possible to prevent fingers and the like from being caught on the tip end 53*a*.

Further, according to the slider 1 of the present embodiment, the restricting portion 34 has a first restricting portion 34*a* on a bottom surface at a front (F direction) side of the shaft member support portions 31, and a restricted portion 7 has a first restricted portion 7*a* on an end surface of the base portion 51 opposite to the gripper 52. Therefore, a space can be effectively utilized.

Further, according to the slider 1 of the present embodiment, the restricting portion 34 has a second restricting portion 34*b* on a wall surface at a front (F direction) side of the pull tab receiving portion 32, and the restricted portion 7 has a second restricted portion 7*b* on an end surface of the base portion 51 opposite to the claw portion 53. Therefore, a space can be effectively utilized.

Further, according to the slider 1 of the present embodiment, the base portion 51 has a contact portion 51*a* configured to come in contact with the first restricting portion 34*a*, and the contact portion 51*a* has a shape of an arc concentric with the shaft member 8 and extends from the first restricted portion 7*a* to the claw portion 53. Therefore, the pull tab 5 can be smoothly rotated.

Further, according to the slider 1 of the present embodiment, the base portion 51 has a body attachment portion 6 including a coil spring receiving portion 61 opened at one of right and left (L-R direction) sides thereof to receive the coil spring 4 therein, and a shaft member insertion portion 62 provided at the other of the right and left (L-R direction) sides to allow the shaft member 8 to be inserted therethrough. Therefore, a space can be effectively utilized.

Further, according to the slider 1 of the present embodiment, the coil spring receiving portion 61 includes a bottom portion 61*a* allowing the coil spring 4 to be installed thereon, and a side wall portion 61*b* formed with the shaft member insertion portion 62. Therefore, the base portion 51 of the pull tab 5 can have an increased strength. Also, since the shaft member insertion portion 62 is formed in the side wall portion 61*b*, the shaft member insertion portion 62 can have an increased precision.

Further, according to the slider 1 of the present embodiment, at least a part of the claw portion 53 and at least a part of the side wall portion 61*b* are included in one predetermined cross section perpendicular to the right and left direction (L-R direction). Therefore, during die-cast injection molding, zinc can be well supplied from the side wall portion 61*b* into the claw portion 53, thereby ensuring that the claw portion 53 is stably molded.

Further, according to the slider 1 of the present embodiment, the bottom portion 61*a* has a coil spring holding portion 61*c* at a side thereof, which is one of right and left (L-R direction) sides thereof and opposite to the gripper 52. Therefore, in a state where the coil spring 4 is received in the coil spring receiving portion 61, the pull tab 5 can be attached to the body 2 from directly above. Thus, deformation of the coil spring 4 can be prevented and also the pull tab 5 can be easily mounted on the body 2.

Further, according to the slider 1 of the present embodiment, the coil spring 4 includes a coil portion 41 having a coil shape and configured to allow the shaft member 8 to be inserted therethrough, a first pressed portion 42 protruding from one end of the coil portion 41 toward an outer peripheral side thereof and thus configured to be in contact with the bottom portion 61*a* of the coil spring receiving portion 61, and a second pressed portion 43 protruding from the other end of the coil portion 41 toward an outer peripheral side thereof opposite to the first pressed portion 42 and thus configured to be held by the coil spring holding portion 61*c* of the coil spring receiving portion 61. Therefore, in a state where a preload is applied to the coil spring 4, the coil spring 4 can be received in the coil spring receiving portion 61. Thus, only by attaching the pull tab 5 on the body 2, an urging force in a direction, toward which the pull tab 5 is laid down, can be acted thereon.

Further, according to the slider 1 of the present embodiment, the first pressed portion 42 has a first bent portion 42*a* extending to one side of the right and left direction (L-R direction) after protruding from the one end of the coil portion 41 toward the outer peripheral side, and the second pressed portion 43 has a second bent portion 43*a* extending to the other side of the right and left direction (L-R direction) after protruding from the other end of the coil portion 41 toward the outer peripheral side thereof opposite to the first pressed portion 42. Thus, the coil spring 4 can be stably received.

Further, according to the slider 1 of the present embodiment, the base portion 51 has a recess-shaped stepped portion 51*b* provided at a side, on which the coil spring 4 is installed, of right and left (L-R direction) sides of the restricted portion 7. Therefore, as the pull tab 5 is raised up, the second bent portion 43*b* of the second pressed portion 43 of the coil spring 4 is fitted from the curved surface 51*a* into the stepped portion 51*b*. Thus, a resistance occurred due to the second bent portion 43*b* while the pull tab 5 is rotated can be reduced, thereby allowing the pull tab 5 to be more smoothly rotated.

Meanwhile, although various embodiments of the present invention have been described, the invention is not limited to the foregoing embodiments, and accordingly any other embodiments modified from configurations of each of the foregoing embodiments or configured by appropriately combining configurations of the foregoing embodiments are also intended to be fallen within the scope of the invention.

What is claimed is:

1. A slider for slide fastener, comprising:

a body having an upper blade and a lower blade connected by a guide post and having a guide groove between the upper blade and the lower blade;

a pull tab having a base portion rotatably attached to the body, a gripper extending from the base portion and a claw portion protruding from the base portion;

a shaft member inserted through the pull tab, supported by the body at both ends thereof and configured to rotatably support the pull tab relative to the body; and a coil spring attached around the shaft member so as to urge the gripper of the pull tab to be laid down toward the body, wherein the body comprises:

a claw guide portion formed in the upper blade to allow a tip end of the claw portion to protrude into the guide groove when the pull tab is laid down toward the body; and a restricting portion for restricting rotation of the pull tab when the pull tab is raised by a predetermined angle from the body, and wherein the pull tab comprises:

a restricted portion coming in contact with the restricting portion when the pull tab is raised by the predetermined angle from the body.

2. The slider for slide fastener according to claim 1, wherein the restricted portion is a flat surface.

3. The slider for slide fastener according to claim 1, wherein the restricting portion is a flat surface.

4. The slider for slide fastener according to claim 1, wherein a width, in a right and left direction, of the restricted portion are longer than a half of a width, in the right and left direction, of an upper surface of the base portion.

5. The slider for slide fastener according to claim 1, wherein the body comprises:

shaft member support portions protruding upward from both end portions, in a right and left direction, of the upper blade and configured to allow the shaft member to be inserted therein; and a pull tab receiving portion formed in a recess shape at a middle portion, in the right and left direction, between the shaft member support portions and configured to receive the base portion of the pull tab therein, and wherein when the pull tab is raised up, the tip end of the claw portion is concealed without protruding from the body as viewed in the right and left direction.

6. The slider for slide fastener according to claim 5, wherein the restricting portion has a first restricting portion on a bottom surface at a front side of the shaft member support portions, and wherein the restricted portion has a first restricted portion on an end surface of the base portion opposite to the gripper.

7. The slider for slide fastener according to claim 6, wherein the base portion has a contact portion configured to come in contact with the first restricting portion, wherein the contact portion has a shape of an arc concentric with the shaft member and extends from the first restricted portion to the claw portion.

8. The slider for slide fastener according to claim 5, wherein the restricting portion has a second restricting portion on a wall surface at a front side of the pull tab receiving portion, and wherein the restricted portion has a second restricted portion on an end surface of the base portion opposite to the claw portion.

9. The slider for slide fastener according to claim 1, wherein the base portion has a body attachment portion comprising:

a coil spring receiving portion opened at one of right and left sides thereof to receive the coil spring therein; and a shaft member insertion portion provided at the other of the right and left sides to allow the shaft member to be inserted therethrough.

10. The slider for slide fastener according to claim 9, wherein the coil spring receiving portion comprises:

a bottom portion allowing the coil spring to be installed thereon; and a side wall portion formed with the shaft member insertion portion.

11. The slider for slide fastener according to claim 10, wherein at least a part of the claw portion and at least a part of the side wall portion are included in one predetermined cross section perpendicular to the right and left direction.

12. The slider for slide fastener according to claim 10, wherein the bottom portion has a coil spring holding portion at a side thereof, which is one of the right and left sides thereof and opposite to the gripper.

13. The slider for slide fastener according to claim 10, wherein the coil spring comprises:

a coil portion having a coil shape and configured to allow the shaft member to be inserted therethrough;

a first pressed portion protruding from one end of the coil portion toward an outer peripheral side thereof and configured to be in contact with the bottom portion of the coil spring receiving portion; and a second pressed portion protruding from the other end of the coil portion toward an outer peripheral side thereof opposite to the first pressed portion and configured to be held by the coil spring holding portion of the coil spring receiving portion.

14. The slider for slide fastener according to claim 13, wherein the first pressed portion has a first bent portion extending to one side of the right and left direction after protruding from the one end of the coil portion toward the outer peripheral side, and wherein the second pressed portion has a second bent portion extending to the other side of the right and left direction after protruding from the other end of the coil portion toward the outer peripheral side thereof opposite to the first pressed portion.

15. The slider for slide fastener according to claim 14, wherein the base portion has a recess-shaped stepped portion provided at a side, on which the coil spring is installed, of right and left sides of the restricted portion.

* * * * *